US008615973B2

(12) United States Patent
Mondry et al.

(10) Patent No.: US 8,615,973 B2
(45) Date of Patent: Dec. 31, 2013

(54) PACKAGING MACHINE FOR PRODUCING A MULTILAYER PACKAGE

(75) Inventors: Hans Mondry, Kempten (DE); Dieter Holzem, Erolzheim (DE)

(73) Assignee: Multivac Sepp Haggenmueller GmbH & Co. KG, Wolfertschwenden (DE)

( * ) Notice: Subject to any disclaimer, the term of this patent is extended or adjusted under 35 U.S.C. 154(b) by 0 days.

(21) Appl. No.: 13/367,845

(22) Filed: Feb. 7, 2012

(65) Prior Publication Data

US 2012/0201481 A1 Aug. 9, 2012

(30) Foreign Application Priority Data

Feb. 8, 2011 (DE) ..... 10 2011 010 601

(51) Int. Cl.
*B65B 31/02* (2006.01)

(52) U.S. Cl.
USPC ..... 53/511; 53/432; 53/433; 53/510

(58) Field of Classification Search
USPC ..... 53/428, 432–434, 449, 443, 452–453, 53/79, 86, 97, 122, 111 R, 510–511
See application file for complete search history.

(56) References Cited

U.S. PATENT DOCUMENTS

| | | | | | |
|---|---|---|---|---|---|
| 4,201,030 | A * | 5/1980 | Mahaffy et al. | 53/432 |
| 4,229,927 | A * | 10/1980 | Day | 53/433 |
| 4,256,690 | A * | 3/1981 | Sabba | 264/504 |
| 4,308,711 | A * | 1/1982 | Mahaffy et al. | 53/511 |
| 4,437,293 | A * | 3/1984 | Sanborn, Jr. | 53/412 |
| 5,103,618 | A * | 4/1992 | Garwood | 53/433 |
| 5,738,816 | A * | 4/1998 | Tidemann et al. | 264/553 |
| 6,868,654 | B2 * | 3/2005 | Douglas | 53/511 |
| 7,205,016 | B2 * | 4/2007 | Garwood | 426/108 |
| 7,386,971 | B2 * | 6/2008 | Catlin et al. | 53/537 |
| 8,381,497 | B2 * | 2/2013 | Scheibel et al. | 53/449 |
| 2005/0126941 | A1 * | 6/2005 | Ferri et al. | 206/323 |
| 2007/0187855 | A1 * | 8/2007 | Jacobson | 264/37.1 |

FOREIGN PATENT DOCUMENTS

| | | | |
|---|---|---|---|
| DE | 3404451 | A1 | 8/1985 |
| DE | 3687987 | T2 | 7/1993 |
| DE | 202005015901 | U1 | 12/2005 |
| DE | 60123678 | T2 | 1/2007 |
| DE | 202010009454 | U1 | 10/2010 |
| EP | 1908689 | A2 | 4/2008 |
| WO | 8800907 | A1 | 2/1988 |
| WO | 02058746 | A1 | 8/2002 |

* cited by examiner

*Primary Examiner* — Christopher Harmon
(74) *Attorney, Agent, or Firm* — Husch Blackwell LLP

(57) ABSTRACT

The invention relates to a thermoform packaging machine for manufacturing a multilayer package, to methods for manufacturing a multilayer package comprising three or four product layers as well as to multilayer packages comprising three or four product layers.

7 Claims, 3 Drawing Sheets

PACKAGING MACHINE FOR PRODUCING A MULTILAYER PACKAGE

CROSS-REFERENCE TO RELATED APPLICATIONS

This application claims foreign priority benefits under 35 U.S.C. §119(a)-(d) to German patent application number DE 10 2011 010 601.4, filed Feb. 8, 2011, which is incorporated by reference in its entirety.

TECHNICAL FIELD

The present disclosure relates to a thermoform packaging machine, a method of manufacturing a multilayer package, as well as a multilayer package comprising three product layers, and a multilayer package comprising four product layers.

BACKGROUND

Thermoform packaging machines of the type R535, produced by the applicant's firm are known. For producing a multilayer package comprising two product layers, these thermoform packaging machines can be equipped with separate work stations for cutting evacuation and gas flushing openings, and for circumferentially sealing evacuation and gas flushing openings so that both product layers can be evacuated and/or flushed with gas separately. The thermoform packaging machine can be extended by a work station for applying a corner cut.

Another thermoform packaging machine for producing a multilayer package is disclosed by DE 20 2005 015 901 U1. Here, a first product layer is fed in on a first film web, a second film web is supplied and positioned on top of the first product layer and a second product layer is placed onto the second film web. Together with an additional film web, the total group of three films comprising the two product layers therebetween is supplied to a sealing station. In so doing, the two product layers are evacuated and/or flushed with gas in common and subsequently the three film webs are all circumferentially sealed to one another so as to obtain a package with two separate product layers, and in a subsequent cutting station a separation step is executed. The second (central) film web is narrower than the first and third film webs so as not to cover the evacuation and gas flushing nozzles. This prior art is disadvantageous insofar as it is impossible to evacuate and/or flush with gas the different product layers precisely or differently.

A multilayer package with opening aids is disclosed in DE 20 2010 009 454 U1. Here, all the films are peelably sealed onto one another, and the package has opening aids on different corners so as to make the various product layers easily accessible. The films have different degrees of peelability so that the film for the upper product layer can be removed more easily than the middle film for the lower product layer. A packaging machine or a method of manufacturing such a multilayer package by means of a thermoform packaging machine is not referred to anywhere in this publication.

SUMMARY

It is an object of the present disclosure to improve a thermoform packaging machine and a method of manufacturing opening aids of a multilayer package comprising different products with respect to the possibility of opening the various product layers.

A thermoform packaging machine according to the present disclosure comprises a plurality of work stations for manufacturing a multilayer package. A multilayer package comprises identical or different layers of products. The packed content of such a multilayer package is, e.g., a layer of a first kind of shingled sausage and an additional layer of a second kind of shingled sausage. The packed content may also consist of one or a plurality of layers of sliced cheese. A first work station is a forming station for thermoforming troughs into a lower web. The lower web is often a hard foil so that the deformation will also retain its shape when the package has been formed and offer a desired stability to the package. The lower web may also be a soft film, when it is desired that the lower web should fit around the product after evacuation. The forming station is also suitable for cutting evacuation and/or gas flushing openings.

In addition, the thermoform packaging machine also comprises a sealing station as a work station for evacuating and/or gas flushing as well as for sealing the lower web and all additionally supplied top webs of the package onto one another. The thermoform packaging machine according to the present disclosure is characterized in that at least one intermediate work station, which is arranged downstream of the forming station and upstream of the sealing station when seen in the direction of production and which is provided for one format (i.e., through which packaging webs travel in a single work cycle), provides a cutting unit for cutting at least one evacuation and/or gas flushing opening as well as a sealing unit for applying a circumferential seal sectionwise to at least one evacuation and/or gas flushing opening. This combination of functions of a single work station within one cycle offers the advantage that, in comparison with a separate sealing station and a separate cutting station, one station can be dispensed with. One cycle is here defined as a work cycle in which a format (number of troughs advanced in one feed movement) is processed. After each cycle, during which the format is standing still, the format is advanced by one feed distance so as to supply the format to a next following work station. In thermoform packaging machines the work stations normally have the dimensions of the respective formats conveyed during one feed motion, i.e., a length of up to 1200 mm. In the case of a format of e.g., two troughs or packages, a plurality of functions or operating steps, such as circumferential sealing and/or cutting of evacuation and gas flushing openings as well as in addition perhaps corner cuts or corner sealing, are carried out in an intermediate work station according to the present disclosure. The overall length of a thermoform packaging machine according to the present disclosure can thus be reduced substantially. Especially when the multilayer package to be manufactured comprises three or more product layers, at least two intermediate work stations are provided, which each comprise a cutting unit for cutting evacuation and gas flushing openings and a sealing unit. In comparison with the length of a known thermoform packaging machine, the length of the present thermoform packaging machine is reduced by at least two feed distances or formats.

Preferably, the intermediate work station comprises a cutting unit for cutting a corner of the multilayer package. The intermediate work station is advantageously provided with a corner sealing unit for sealing webs on a corner of the package. This corner sealing unit forms opening aids on the package, a respective corner being configured such that one web can be pulled off from another web so as to provide access to a product layer. The consumer can grasp one corner, which is sealed together with all webs as a corner seal, with two fingers. Thus, the consumer need not fan out the webs on one corner so as to be able to pull off the desired web from the respective web located therebelow.

Preferably, the thermoform packaging machine comprises, for a number n of product layers separated by webs, a number n−1 of intermediate work stations so as to reduce the machine length to a minimum.

According to a preferred embodiment, the sealing station comprises an upper tool component and a lower tool component so as to hermetically clamp all webs on all sides thereof This allows separate and different evacuation and/or gas flushing of each individual product layer. The evacuation and/or gas flushing nozzles are arranged within the clamping area so as to evacuate and/or flush with gas a space between two webs, said evacuation and/or gas flushing nozzles projecting at least through the lower web up to a point below the web of the space to be evacuated.

A method according to the present disclosure used for manufacturing a multilayer package comprising three product layers, which are separated by webs, comprises the following steps:

In a forming station, troughs are formed in a lower web and evacuation and/or gas flushing openings are cut at the boundary of the lower web.

A corner is cut in a cutting station following in the direction of production.

Subsequently, a first product layer is fed into the formed trough.

The bottom web with the first product layer is then supplied with a first top web into a first intermediate work station for cutting an evacuation and/or gas flushing opening, for circumferentially sealing an evacuation and/or gas flushing opening and for cutting a corner through both webs.

Analogously to the two preceding steps, a second product layer is fed onto the first top web.

The bottom web with the first product layer and the first top web with the second product layer are then supplied together with a second top web into a second intermediate work station for cutting an evacuation and/or gas flushing opening, for circumferentially sealing an evacuation and/or gas flushing opening and for sealing a corner and/or for cutting a corner through all three webs.

This is followed by the step of feeding a third product layer onto the second top web.

The bottom web, the first top web with the first product layer, the second top web with the second product layer and a third top web are supplied into a sealing station for evacuating and/or gas flushing all product layers and for sealing the multilayer package as well as for sealing at least one corner.

After the sealing station the individual packages are separated from the webs.

Between the individual steps a web feed motion takes place, i.e., the web feed motion conveys the webs along the work stations. These work stations also include infeed stations for feeding in the product layers.

This method is characterized in that in the intermediate work stations a plurality of functions are carried out, such as cutting of corners, cutting of evacuation and/or gas flushing openings, sealing of corners and/or circumferentially sealing evacuation and/or gas flushing openings. Therefore, several work stations, which have hitherto only carried out a single one of the above-mentioned functions, can be dispensed with, and the machine length as well as the overall cost for such a thermoform packaging machine will be reduced.

The method according to the present disclosure used for manufacturing a package comprising four product layers, which are separated by webs, provides analogously at least the steps which are provided in the case of a multilayer package comprising three product layers and, in addition, a further infeed line for feeding a fourth product layer onto the third top web. In an additional intermediate station, corner sealing and a corner cut as well as circumferential sealing of an evacuation and/or gas flushing opening are carried out.

In the forming station or in a cutting station, four evacuation and/or gas flushing openings are cut in accordance with the number of product layers.

In the sealing station, all product layers are evacuated and/or flushed with gas and the package as well as at least two corners, preferably three corners, are sealed.

In the case of both methods, all the webs which are present in an intermediate work station are clamped together by an upper tool component and a lower tool component on all sides thereof. The product layers present in the intermediate work station can already be pre-sealed in this way.

In the case of a multilayer package comprising three product layers according to the present disclosure a specific corner is provided for pulling off a specific web from a neighbouring web. The user can thus provide access to the desired product layer simply and unequivocally.

Preferably, at least two corners are sealed together across all webs so that the consumer need not fan out any web ears, but will be able to grasp the desired corner with two fingers and separate the webs.

According to an advantageous embodiment a corner cut is provided on at least two corners so as to guarantee that a web can be pulled off from a neighbouring web unequivocally, thus providing access to a product layer.

In the case of a multilayer package comprising four product layers according to the present disclosure, a respective specific corner is provided for pulling off a specific web from a neighbouring web. Thus, the user will be able to provide access to the desired product layer simply and unequivocally.

Preferably, at least three corners are sealed together across all webs, so that the user need not fan out any web ears, but will be able to grasp the desired corner with two fingers and separate the webs.

According to an advantageous embodiment a corner cut is provided on at least three corners so as to guarantee that a web can be pulled off from a neighbouring web unequivocally, thus providing access to a product layer.

Further variants comprising more than four product layers are imaginable, e.g., a package comprising six product layers and six corners in the form of a hexagon.

In the following, an advantageous embodiment of the disclosure is explained in more detail with reference to the below drawings.

DETAILED DESCRIPTION

Figure 1:
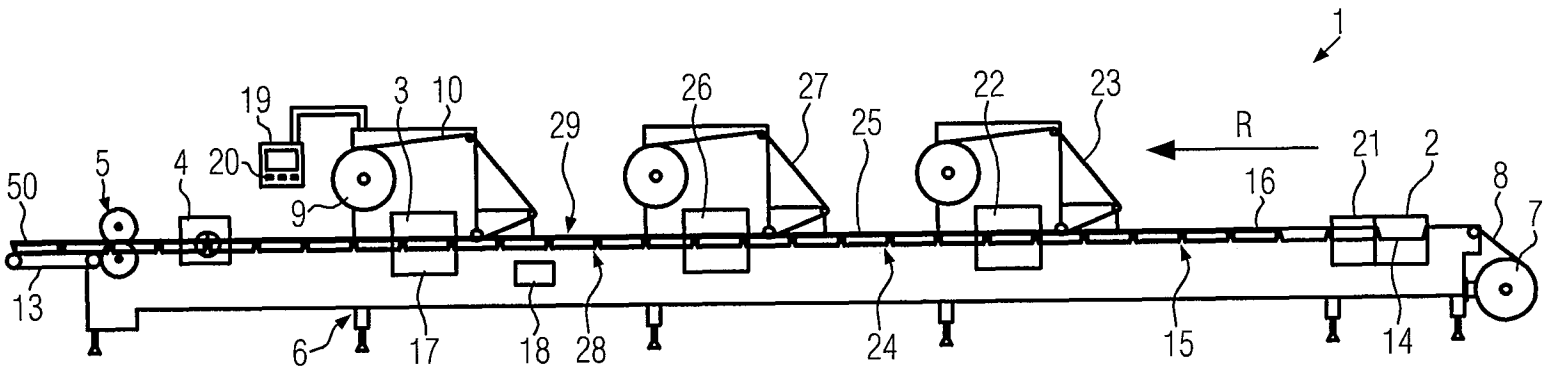
FIG. 1 is a schematic side view of a thermoform packaging machine according to the present disclosure.

FIG. 1 shows a schematic view of a packaging machine in the form of a thermoform packaging machine 1. This thermoform packaging machine 1 comprises a forming station 2, a sealing station 3, a cross cutting unit 4 and a longitudinal cutting unit 5, which are arranged in this order in a working direction R on a machine frame 6.

On the input side, a supply roll 7 is provided on the machine frame 6, from which a bottom web 8 is unwound. In the area of the sealing station 3, a material storage unit 9 is provided, from which a top web 10 is unwound as a lidding or cover web. On the output side, a discharge device 13 in the form of a conveyor belt is provided at the packaging machine, with which finished, singulated packages are transported away. Furthermore, the packaging machine 1 comprises a feeding device which is not shown, said feeding device gripping the first web-shaped material 8 and transporting it cyclically in a main work cycle in the working direction R. The feeding device can be realized, e.g., by laterally arranged transport chains.

In the embodiment shown, the forming station 2 is implemented as a thermoforming station in which troughs 14 are formed in the first web-shaped material 8 by thermoforming. The forming station 2 can be configured such that in the direction perpendicular to the working direction R several containers are formed side by side. The forming station 2 also cuts evacuation and/or gas flushing openings into both lateral boundary areas. Immediately afterwards, a corner cut is formed in the bottom web 8 in the cutting station 21.

An infeed line 15, along which the troughs 14 formed in the bottom web 8 are filled with a first product layer 16, is arranged downstream of the cutting station 21 in the working direction R.

This infeed line 15 is followed by a first intermediate work station 22 into which the bottom web 8 with the first product layer 16 and a first top web 23 are conveyed. The first intermediate work station 22 cuts evacuation and/or gas flushing openings and corners in both boundary areas of the bottom web 8 into both webs 8 and 23. The evacuation and/or gas flushing openings are circumferentially sealed, at least partially.

The intermediate work station 22 is followed by a second infeed line 24 along which a second product layer 25 is fed onto the first top web 23 above the troughs 14.

The second infeed line 24 is followed by a second intermediate work station 26 into which the bottom web 8 with the first product layer 16, the first top web 23 with the second product layer 25 and a second top web 27 are conveyed. The second intermediate work station 26 cuts evacuation and/or gas flushing openings in both boundary areas of the bottom web 8 into the three webs 8, 23 and 27. The evacuation and/or gas flushing openings are circumferentially sealed, at least partially. A corner, which has not been cut in the cutting station 21 and in the first intermediate work station 22, is sealed, i.e., the three webs 8, 23 and 27 are sealed onto one another in this corner area.

The second intermediate work station 26 is followed by a third infeed line 28 along which a third product layer 29 is fed onto the second top web 27 above the troughs 14.

The third infeed line 28 is followed by the sealing station 3 into which the lower web 8 with the first product layer 16, the first top web 23 with the second product layer 25, the second top web 27 with the third product layer 29 and a third top web 10 are conveyed. The sealing station 3 is provided with a closable chamber 17 in which the atmospheres of the three product layers 16, 25, 29 can, prior to sealing, be substituted for each product layer identically, or differently, by a substitute gas or a substitute gas mixture, e.g., by means of precise reintroduction of gas or gas flushing. The fact that evacuation and/or gas flushing openings 30*a*, 30*b*, 30*c* at a different number of webs 8, 23, 27, 10 are circumferentially sealed has the effect that each evacuation and/or gas flushing opening 30*a*, 30*b*, 30*c* is associated with a space between two specific webs and with a specific product layer 16, 25, 29, respectively, and is separated from the openings leading to the other spaces.

The cross cutting unit 4 is implemented as a punch which cuts through the bottom web 8 and the three top webs 23, 27 and 10 between neighbouring troughs 14 in a direction transversely to the working direction R. In so doing, the cross cutting unit 4 works such that the bottom web 8 is not cut through across the whole width thereof, but remains uncut at least in a boundary area thereof. This allows controlled further conveyance by the feeding device.

In the embodiment shown, the longitudinal cutting unit 5 is implemented as a knife unit by means of which the bottom web 8 and the top webs 23, 27 and 10 are cut through between neighbouring troughs 14 and at the lateral boundary of the bottom web 8 so that singulated multilayer layer packages 50 are obtained downstream of the longitudinal cutting unit 5.

The packaging machine 1 is additionally provided with a controller 18. This controller 18 has the function of controlling and monitoring the processes taking place in the thermoform packaging machine 1. A display device 19 with control elements 20 is used for visualizing for and influencing by an operator the sequences of processes taking place in the thermoform packaging machine 1.

Figure 2:
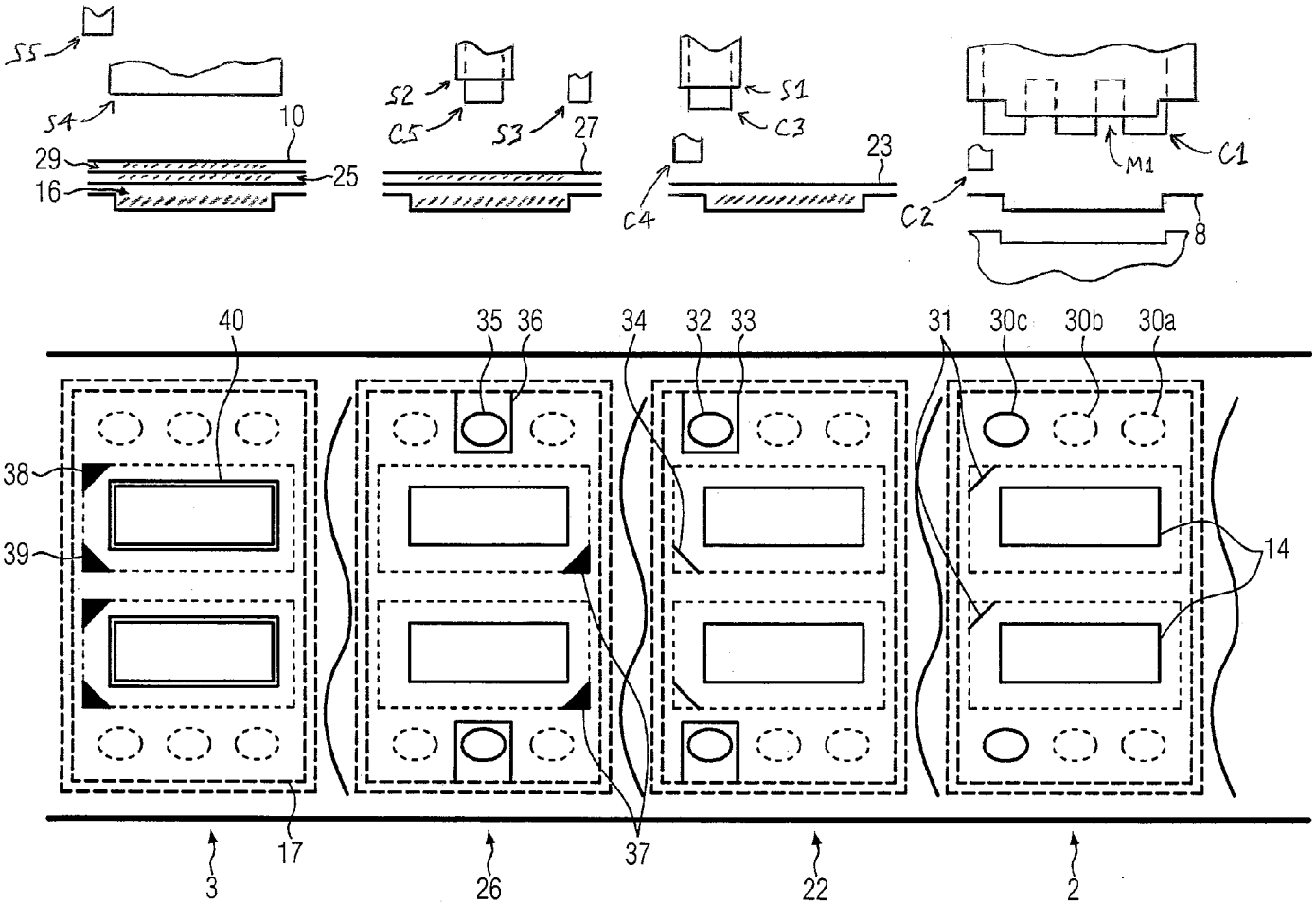
FIG. 2 is a schematic representation of the functions of the work stations.

FIG. 2 shows in the upper part thereof a schematic vertical section through a multilayer package, along with schematic views of various tools of the work stations, and in the lower part thereof a schematic top view of the work stations, such as the forming station 2 (in combination with the cutting station 21), the first intermediate work station 22, the second intermediate work station 26 and the sealing station 3.

In the forming station 2 two troughs 14 are formed in the bottom web 8 using one or more mold tools, such as mold tool M1, and three evacuation and gas flushing openings 30*a*, 30*b*, 30*c* are cut in the boundary area on both sides by one or more cutting devices or units, such as cutting unit C1. In the cutting station 21 two corner cuts 31 are formed in the bottom web 8 using one or more cutting devices or units, such as cutting unit C2. The mold tool M1, or a portion thereof (such as the upper part of mold tool M1), and the cutting units C1 and C2 may be separate devices or combined together in any suitable manner as one or more devices.

After the first infeed line 15 and the supply of the first top web 23, evacuation and gas flushing openings 32 are cut in the boundary area of the bottom web 8 on both sides in the first intermediate work station 22 using one or more cutting devices or units, such as cutting unit C3, said evacuation and gas flushing openings 32 each being sectionwise enclosed by a seal 33 that may be formed using one or more sealing devices or units, such as sealing unit S1. When the evacuation and gas flushing opening 30*c* has already been formed in the forming station 2, only the first top web 23 is cut congruently at the evacuation and gas flushing opening 30*c*. It is, however, also imaginable to cut the whole evacuation and gas flashing opening 30*c* through all the provided webs only in the intermediate work station 22, 26, in which the adequate number of webs 8, 23, 27, 10 to be cut is present. In addition, two corner cuts 34 are cut through both webs 8, 23 in the area close to the troughs 14 by one or more cutting devices or units, such as cutting unit C4; these corner cuts 34 are not identical or congruent with the position of the corner cuts 31. The cutting units C3 and C4 and the sealing unit 51 may be separate devices or combined together in any suitable manner as one or more devices.

After the second infeed line 24 and the supply of the second top web 27, evacuation and gas flushing openings 35 are cut in the boundary area of the bottom web 8 on both sides in the second intermediate work station 26 using one or more cutting devices or units, such as cutting unit C5, and a circumferential seal 36 is formed around each of said evacuation and gas flushing openings 35 by one or more sealing devices or units, such as sealing unit S2. In addition, two corner seals 37 are formed using one or more sealing devices or units, such as sealing unit S3, and the corner seals 37 each seal the three webs 8, 23 and 27 onto one another at the corner in question. The cutting unit C5 and the sealing units S2 and S3 may be separate devices or combined together in any suitable manner as one or more devices.

After the third infeed line 28 and the supply of the third top web 10, the individual product layers 16, 25 and 29 are evacuated and/or flushed with gas via the three evacuation and gas flushing openings 30*a*, 30*b*, 30*c* in the sealing station 3. In so doing, evacuation and/or subsequent flushing with gas is carried out for the lowermost product layer 16 via the evacuation opening 30*a*, the middle product layer 25 via the evacuation opening 30*c* and the upper product layer 29 via the evacuation opening 30*b*. The circumferential seals 33, 36 produced in the intermediate work stations 22, 26 and enclosing the evacuation openings 32, 35 and 30*c*, 30*b*, respectively, have the effect that the evacuation openings 30*a*, 30*b*, 30*c* are unequivocally associated with the product layers 16, 25, 29. In the sealing station 3 the chamber 17 hermetically clamps all webs 8, 23, 25, 10 together on all sides thereof. In said sealing station 3 the frame seal 40 for the package 50 (cf. FIG. 2) is provided using a sealing device or unit, such as sealing unit S4, the evacuation and gas flushing openings 30*a*, 30*b*, 30*c* being disposed outside said frame seal 40 in the lateral boundary area of the webs 8, 23, 27, 10. Also the corners 38 and 39, which have been cut in the cutting station 21 or in the first intermediate work station 22, are sealed onto one another across all four webs 8, 23, 25, 10 by one or more sealing devices or units, such as sealing unit S5. The sealing units S4 and S5 may be separate devices or combined together as one device.

Alternatively, a multilayer package comprising four product layers can be produced in an analogous manner. To this end, a further infeed line, a further top web and a further intermediate work station are provided. In the case of this variant, a corner cut is provided in the intermediate work station 26 and a further corner is additionally sealed in the sealing station 3.

Figure 3:
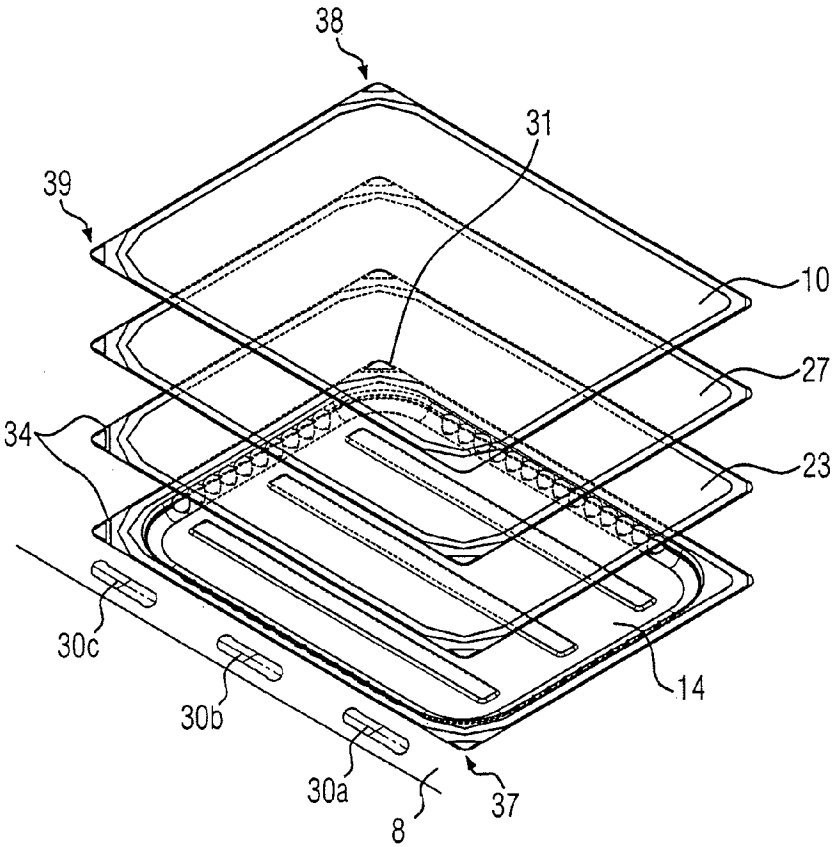
FIG. 3 is an exploded view of a multilayer package comprising three product layers according to the present disclosure.

FIG. 3 shows a multilayer package 50 with three product layers, which are not shown, in an exploded view with the bottom web 8 having formed therein the trough 14 as well as evacuation and gas flashing openings 30*a*, 30*b*, 30*c* that are provided in the lateral boundary area. Above the bottom web 8 the three top webs 23, 27, 10 are shown. These top webs are sealed together at the three corners 37, 38, 39 as well as at the frame seal 40 (cf. FIG. 2) so as to hermetically seal the product layers 16, 25, 29, which are not shown in FIG. 3, against the atmosphere. The corner cuts shown are corner cuts 31 and 34.

A multilayer package comprising four product layers is sealed at the fourth corner, which has not yet been sealed, and is provided with a corner cut of the bottom web 8 and the top webs 23 and 27. Each corner is thus unequivocally associated with a product layer.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A thermoform packaging machine comprising:

a plurality of work stations for manufacturing a multilayer package, the work stations including a first work station provided as a forming station for thermoforming a trough into a lower web and for cutting evacuation and/or gas flushing openings in the lower web, a second work station provided as a sealing station for evacuating and/or gas flushing and for sealing the lower web and all additionally supplied top webs of the multilayer package onto one another, and at least one intermediate work station arranged downstream of the forming station and upstream of the sealing station, when seen in the direction of production, the at least one intermediate work station comprising a cutting unit for cutting at least one evacuation and/or gas flushing opening in the one or more top webs applied prior to entering the at least one intermediate work station as well as a sealing unit for applying at least a partial circumferential seal between the lower web and the one or more top webs and around the at least one evacuation and/or gas flushing opening cut at the at least one intermediate work station.

2. A thermoform packaging machine according to claim 1 wherein the at least one intermediate work station comprises a corner cutting unit for cutting a corner of the multilayer package.

3. A thermoform packaging machine according to claim 1 wherein the at least one intermediate work station comprises a corner sealing unit for sealing the lower web and the one or more top webs on a corner of the multilayer package.

4. A thermoform packaging machine according to claim 1 wherein the multilayer package is configured to receive a number n of product layers separated by the top webs, and the thermoform packaging machine comprises a number n−1 of the intermediate work stations.

5. A thermoform packaging machine according to claim 1 wherein the second station comprises an upper tool component and a lower tool component defining together a chamber for hermetically clamping together the lower web and all top webs on all sides thereof.

6. The thermoform packaging machine of claim 1 wherein the multilayer package comprises the lower web and at least two top webs.

7. The thermoform packaging machine of claim 1 wherein the first work station cuts evacuation and/or gas flushing openings in a lateral binding area of the lower web, the lateral binding area being adjacent to the trough.

* * * * *